US011535441B2

(12) United States Patent
Chen et al.

(10) Patent No.: US 11,535,441 B2
(45) Date of Patent: Dec. 27, 2022

(54) PACKAGING KIT AND REFILL CONTAINER

(71) Applicant: Conopco, Inc., Englewood Cliffs, NJ (US)

(72) Inventors: Weiqing Chen, Shanghai (CN); Marc Y Phu, Shanghai (CN)

(73) Assignee: Conopco, Inc., Englewood Cliffs, NJ (US)

( * ) Notice: Subject to any disclaimer, the term of this patent is extended or adjusted under 35 U.S.C. 154(b) by 270 days.

(21) Appl. No.: 16/607,499

(22) PCT Filed: Apr. 10, 2018

(86) PCT No.: PCT/EP2018/059077
§ 371 (c)(1),
(2) Date: Oct. 23, 2019

(87) PCT Pub. No.: WO2018/202385
PCT Pub. Date: Nov. 8, 2018

(65) Prior Publication Data

US 2020/0071047 A1 Mar. 5, 2020

(30) Foreign Application Priority Data

May 4, 2017 (WO) ..... PCT/CN2017/083016
Jun. 13, 2017 (EP) ..... 17175685

(51) Int. Cl.
*B65D 77/04* (2006.01)
*B65D 43/02* (2006.01)

(52) U.S. Cl.
CPC ..... *B65D 77/0486* (2013.01); *B65D 43/0231* (2013.01)

(58) Field of Classification Search
CPC ..... B65D 77/0486; B65D 77/0493; B65D 43/0231; A45D 40/0075; A45D 40/16; A45D 40/0068

(Continued)

(56) References Cited

U.S. PATENT DOCUMENTS 933,444 A * 9/1909 Henke ..... B65D 1/265 220/506
1,450,674 A * 4/1923 Marston ..... A45C 7/0031 220/8

(Continued)

FOREIGN PATENT DOCUMENTS

CH 707068 4/2014
CN 1337349 2/2002

(Continued)

OTHER PUBLICATIONS

Search Report and Written Opinion in EP17175685; dated Dec. 6, 2017.

(Continued)

*Primary Examiner* — Chun Hoi Cheung
*Assistant Examiner* — Brijesh V. Patel
(74) *Attorney, Agent, or Firm* — Gerard J. McGowan, Jr.

(57) ABSTRACT

A consumer product packaging kit comprising a closure (1), an outer container (2) and an inner container (3) capable of releasably engaging with and inside of the outer container (2), wherein;

C) the outer container (2) comprises:
a) an open mouth (21) at the top of the outer container (2),
b) a shoulder (22),
c) a body (23),
d) an open base (24) at the bottom of the outer container (2),
e) an annular extension (26) longitudinally offset from the open mouth (21), and
f) an engagement structure (27); and D) the inner container (3) for containing consumer product comprises:
(v) an open top end (31) releasably engaging with the annular extension (26), (Continued)

(vi) a side wall (32),
(vii) a closed bottom end (33), and
(viii) an engagement coupler (34) cooperating with the engagement structure (27).

5 Claims, 4 Drawing Sheets

(58) Field of Classification Search
USPC ..... 206/216, 363, 482, 317, 315.1, 315.11; 220/592.15, 592.23, 23.83, 23.87, 23.89, 220/666, 8, 218, 144; 222/156, 183, 222/321.7, 321.9, 325, 402.1, 402.13; 401/119, 132, 134, 209, 213–214
See application file for complete search history.

(56) References Cited

U.S. PATENT DOCUMENTS 2,076,550 A * 4/1937 Conner ..... A45D 40/0068 220/62.18
2,077,215 A * 4/1937 Conner ..... A45D 40/0068 215/12.1
2,077,216 A * 4/1937 Conner ..... A45D 40/0068 215/12.1
2,077,218 A * 4/1937 Conner ..... A45D 40/0068 215/386
2,114,872 A * 4/1938 Conner ..... B65D 11/16 206/363
2,328,872 A * 9/1943 Yealdhall ..... B65D 85/816 206/217
2,629,508 A 2/1953 Martin
2,766,796 A 10/1956 Tupper
2,836,323 A * 5/1958 Robinson ..... B65D 71/00 220/4.27
3,093,256 A * 6/1963 Woodbury, Jr. ..... A61J 9/00 215/11.1
3,311,248 A * 3/1967 Marchant ..... A45D 40/0068 D7/608
3,332,429 A 7/1967 Bates
3,347,423 A * 10/1967 Babbin ..... B65D 83/206 222/23
3,514,008 A * 5/1970 Dorn ..... B65D 25/00 220/8
3,620,399 A * 11/1971 Repeaud ..... B65D 11/16 222/105
3,768,697 A * 10/1973 Lerner ..... B67B 7/26 222/80
3,871,543 A * 3/1975 Chadfield ..... B65D 11/16 215/12.1
4,165,815 A 8/1979 Vetter
4,240,560 A * 12/1980 Carluccio ..... A45D 40/0068 215/12.1
4,606,775 A 8/1986 Robinson et al.
4,676,408 A * 6/1987 Speitel ..... B65D 83/384 222/183
4,693,366 A * 9/1987 Goncalves ..... B65D 81/3211 215/DIG. 8
4,757,916 A * 7/1988 Goncalves ..... B65D 81/3211 222/153.07
5,078,287 A * 1/1992 Holmes, III ..... A61J 9/00 215/11.1
5,170,888 A * 12/1992 Goncalves ..... B65D 81/3211 206/222
5,356,025 A * 10/1994 Renault ..... A45D 40/0068 132/293
5,358,147 A * 10/1994 Adams ..... B65D 83/386 222/325
5,549,213 A 4/1996 Robbins, III et al.
5,564,600 A * 10/1996 Renault ..... B65D 81/3211 206/221
5,586,694 A * 12/1996 Breidenbach ..... A45D 34/02 222/183
5,707,698 A * 1/1998 Favre ..... A45D 40/00 428/206
5,765,708 A * 6/1998 Fragos ..... B65D 1/0292 220/8
6,006,937 A * 12/1999 Baravaglio ..... A45D 40/0068 206/823
6,068,396 A * 5/2000 Baudin ..... B65D 23/0885 220/796
6,085,927 A 7/2000 Kusz
6,145,685 A * 11/2000 Dick ..... B65D 21/0228 215/10
6,352,168 B1 * 3/2002 Lin ..... A47G 19/2227 220/23.88
6,427,863 B1 * 8/2002 Nichols ..... A47J 39/00 220/23.86
6,739,731 B2 * 5/2004 Katzman ..... B65D 23/14 206/219
6,910,573 B2 * 6/2005 Deans ..... B65D 81/3211 206/222
6,923,347 B2 * 8/2005 Winckels ..... A45D 40/0068 222/206
6,945,419 B2 * 9/2005 Bertazza ..... A45D 40/265 220/23.87
7,467,908 B2 * 12/2008 Francavilla ..... G01F 11/025 222/325
7,523,822 B2 * 4/2009 Sharon ..... B65D 81/3205 206/219
7,735,665 B2 6/2010 Robinson
D625,469 S 10/2010 Dubitsky
D631,204 S 1/2011 Dubitsky et al.
D644,939 S 9/2011 Teller
8,317,042 B2 11/2012 Cerveny
8,342,346 B2 * 1/2013 Rances ..... B65D 81/3205 220/4.26
8,444,337 B2 5/2013 Teller
8,479,940 B2 * 7/2013 Marra ..... B65D 23/0885 220/23.87
8,695,826 B2 * 4/2014 Furey ..... A47G 19/2205 220/23.83
8,870,011 B2 * 10/2014 Hammer ..... B65D 21/0233 220/23.89
8,888,391 B2 11/2014 Teller et al.
9,216,843 B2 * 12/2015 Sorensen ..... B65D 51/28
9,950,827 B1 * 4/2018 Lau ..... B65D 1/04
10,441,053 B2 10/2019 Hong et al.
2001/0027958 A1 10/2001 Short
2005/0258126 A1 * 11/2005 Canamasas Puigbo ..... B65D 81/3841 215/12.1
2006/0043109 A1 * 3/2006 Masuda ..... B65D 83/0055 222/105
2008/0035646 A1 * 2/2008 Smith ..... B65D 21/083 220/526
2008/0230540 A1 * 9/2008 Marra ..... B65D 23/0885 220/796
2009/0022541 A1 1/2009 De Laforcade
2010/0213085 A1 * 8/2010 Belnap ..... A61J 1/2093 206/219
2011/0272410 A1 10/2011 Sato et al.
2011/0309083 A1 * 12/2011 Hsiu-Tzu Charlene ..... B65D 23/085 220/505
2012/0018337 A1 * 1/2012 Furey ..... B65D 23/00 206/520
2013/0075287 A1 * 3/2013 Sharon ..... B65D 81/3222 206/219
2013/0098944 A1 * 4/2013 Broadney ..... B05B 11/0037 222/321.9
2014/0131229 A1 * 5/2014 Tippit ..... B65D 81/3211 206/219
2014/0251938 A1 9/2014 Rose
2015/0076140 A1 * 3/2015 Roesler ..... B65D 41/0492 220/4.01
2015/0076149 A1 * 3/2015 Roesler ..... B65D 25/14 220/212
2016/0159537 A1 6/2016 Pucci

(56) References Cited

U.S. PATENT DOCUMENTS

| | | | | |
|---|---|---|---|---|
| 2016/0251121 | A1* | 9/2016 | Hadar | B65D 41/0471 215/44 |
| 2016/0311601 | A1* | 10/2016 | Genchev | B65D 47/065 |
| 2017/0215553 | A1 | 8/2017 | Keller | |
| 2017/0217635 | A1* | 8/2017 | Johnson | B65D 41/0442 |
| 2017/0275072 | A1* | 9/2017 | Siskron, III | B65D 77/0486 |
| 2017/0318939 | A1* | 11/2017 | Kim | A45D 40/222 |
| 2018/0125198 | A1 | 5/2018 | Burditt | |
| 2018/0271255 | A1* | 9/2018 | Hong | F16J 15/02 |
| 2018/0333216 | A1* | 11/2018 | Whelan | A61B 17/00234 |
| 2018/0334286 | A1* | 11/2018 | Yahalom | B65D 21/0233 |
| 2019/0152649 | A1* | 5/2019 | Hadar | B65D 21/086 |
| 2019/0166975 | A1* | 6/2019 | Hong | B65D 43/165 |
| 2019/0313766 | A1* | 10/2019 | Perl | A45D 34/06 |

FOREIGN PATENT DOCUMENTS

| | | | | |
|---|---|---|---|---|
| CN | 1137256 | | 2/2004 | |
| CN | 101119904 | | 2/2008 | |
| CN | 101605699 | | 12/2009 | |
| CN | 102114934 | | 7/2011 | |
| CN | 203652368 | | 6/2014 | |
| CN | 104229289 | | 12/2014 | |
| CN | 204846772 | | 12/2015 | |
| CN | 105452122 | | 3/2016 | |
| CN | 105877114 | | 8/2016 | |
| CN | 106275811 | | 1/2017 | |
| CN | 206485775 | | 9/2017 | |
| DE | 9317521 | | 1/1994 | |
| DE | 10339807 | | 4/2005 | |
| DE | 102005006238 | A1 * | 7/2006 | B65D 21/0231 |
| EP | 0661012 | A1 * | 7/1995 | B65D 77/0493 |
| EP | 0970634 | | 1/2003 | |
| EP | 2623431 | | 8/2013 | |
| EP | 20150001855 | | 5/2015 | |
| EP | 3243405 | | 11/2017 | |
| FR | 1450924 | | 6/1966 | |
| FR | 2745276 | A1 * | 8/1997 | A45D 40/0068 |
| FR | 2807739 | A1 * | 10/2001 | A45D 40/0068 |
| FR | WO2009092874 | | 7/2009 | |
| GB | 1598682 | A * | 9/1981 | A45D 40/02 |
| GB | 2284254 | A * | 5/1995 | B65D 81/3886 |
| JP | S6342537 | U * | 3/1988 | B65D 21/0231 |
| JP | S6346331 | U * | 3/1988 | B65D 21/0231 |
| JP | 5065828 | | 8/1993 | |
| JP | H0565828 | U * | 8/1993 | |
| JP | H0612324 | U * | 2/1994 | |
| JP | H0613713 | U * | 2/1994 | |
| JP | H07277335 | A * | 10/1995 | |
| JP | H0717538 | A * | 1/1998 | |
| JP | H11268761 | A * | 10/1999 | |
| JP | J4564104 | | 8/2010 | |
| JP | 2011212368 | | 10/2011 | |
| JP | 2013103724 | | 5/2013 | |
| JP | 3185934 | | 9/2013 | |
| JP | 2015030459 | A * | 2/2015 | B65D 21/0231 |
| JP | 2017197283 | A * | 11/2017 | A45D 40/0068 |
| JP | 2018104064 | A * | 7/2018 | A45D 40/0068 |
| JP | 2018140833 | A * | 9/2018 | |
| JP | 2019081595 | A * | 5/2019 | B65D 81/3886 |
| KR | 20160097901 | | 8/2016 | |
| WO | WO-2007022608 | A1 * | 3/2007 | A45D 40/0068 |
| WO | WO2007110596 | | 10/2007 | |
| WO | WO2009123380 | | 10/2009 | |
| WO | WO-2011129866 | A1 * | 10/2011 | A45D 40/0068 |
| WO | WO2016091865 | | 6/2016 | |

OTHER PUBLICATIONS

Search Report and Written Opinion in PCTEP2018059077; dated May 25, 2018.

IPRP in PCTEP2018059077; dated Mar. 19, 2019.

Search Report and Written Opinion in PCTCN2018073215; dated Jan. 18, 2018.

Supplementary Search Report and Written Opinion in EP18742361; dated Mar. 24, 2020.

* cited by examiner

PACKAGING KIT AND REFILL CONTAINER

FIELD OF THE INVENTION

This invention relates to a packaging kit for consumer products containing an outer container and an inner container. The inner container is capable of being easily replaced and there is no product leakage during usage.

BACKGROUND OF THE INVENTION

Consumer products have been provided to facilitate daily life for a very long time. To deliver consumer products safely and conveniently and/or to attract more consumer to buy them, consumer products are usually packed after they are manufactured.

However, the packages for consumer products inevitably end up as waste to the environment. Many methods have been developed to minimize waste from packaging. One of the important ways is to use biodegradable material to replace the plastics for packaging but in such cases the cost is high and the mechanical strength may be compromised. Another way is to use refill packaging. For example, liquid laundry detergents may be packed in flexible plastic bags. When the liquid laundry detergent in the rigid bottles is used up, the consumers can open the flexible plastic bags and pour the liquid detergent into the bottles. One issue with such flexible refill bag is that it is less convenient for consumers and may cause spillage of liquid products.

Effort have been made to develop new refill packaging. For example, US patent application US 2011/0272410 A1 is said to disclose a double container containing an outer container and an exchangeable inner container. However, the structures of the inner container appear complicated and the operability in exchanging the inner container need to be further improved. Therefore, we have recognized that there is still a need to develop a new packaging kit containing a refill container which is capable of easily being replaced and also being manufactured easily.

KR2020150001855 (Pumtech) discloses a consumer product packaging kit comprising a consumer product packaging kit comprising a closure, an outer container and an inner container. The inner container is capable of releasably engaging with and inside of the outer container. The outer container comprises an open mouth at the top, a shoulder, body, an open base and an annular extension. The outer container is devoid of any feature which is literally an engagement structure or even functionally equivalent to such a structure whilst not being literally so. The corresponding inner container comprises an open top, releasably engageable with the annular extension by way of threads to secure the two containers, a side wall and a closed bottom. The inner container is devoid of an engagement coupler (or any equivalent) to cooperate with the engagement structure of the corresponding outer container.

US2011/0272410 A1 (Sato Tatsuo) discloses a dual container in which at the time of replacement of a used inner container with a new one, any movement of the inner container from rotating relative to the outer container is prevented by the provision of ribs on the outer container to engage with the rotation preventing recesses on the inner container. Further, temporary joining hooks are provided on the outer container to join with flange on the inner container to secure the two containers together in position. These features are necessarily located at the top end of the outer container.

JPH05 65828 U (August 1993) discloses a kit in which it is made easier to dispose-off the empty inner container by using biodegradable plastic. The bottom of the outer container is closed, therefore, when the inner container becomes empty, a user needs to insert the new container from the top end of the outer container.

SUMMARY OF THE INVENTION

In a first aspect, the present invention provides a consumer product packaging kit comprising a closure (1), an outer container (2) and an inner container (3) capable of releasably engaging with and inside of the outer container (2), wherein:

A) the outer container (2) comprises:
   a) an open mouth (21) at the top of the outer container (2),
   b) a shoulder (22),
   c) a body (23),
   d) an open base (24) at the bottom of the outer container (2),
   e) an annular extension (26) longitudinally offset from the open mouth (21), and
   f) an engagement structure (27); and B) the inner container (3) for containing consumer product comprises:
   (i) an open top end (31) releasably engaging with the annular extension (26) to secure the inner container (3) to the outer container (2) when the inner container (3) is in a fully engaged position,
   (ii) a side wall (32),
   (iii) a closed bottom end (33), and
   (iv) an engagement coupler (34) cooperating with the engagement structure (27) to secure the inner container (3) to the body (23) of outer container (2) when the inner container (3) is in a fully engaged position, wherein the engagement structure (27) is in the lower portion of the body (23) and the engagement coupler (34) is in the lower portion of the side wall (32).

All other aspects of the present invention will more readily become apparent upon considering the detailed description and examples which follow.

DETAILED DESCRIPTION OF THE INVENTION

Figure 1:
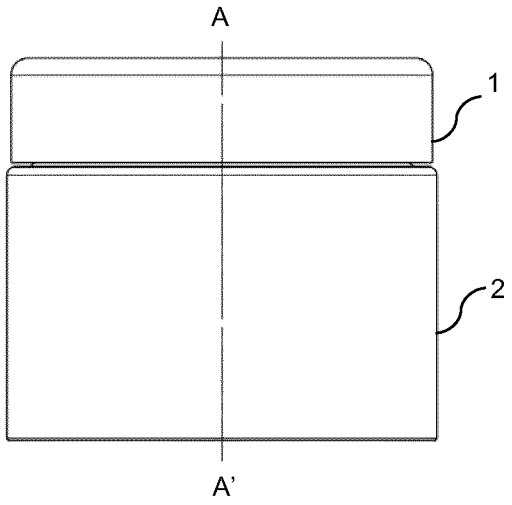
FIG. 1 is a front view of a preferred example of the consumer product packaging kit according to this present invention.

Except in the examples, or where otherwise explicitly indicated, all numbers in this description indicating amounts of material or conditions of reaction, physical properties of materials and/or use may optionally be understood as modified by the word "about".

It should be noted that in specifying any range of values, any particular upper value can be associated with any particular lower value.

For the avoidance of doubt, the word "comprising" is intended to mean "including" but not necessarily "consisting of" or "composed of". In other words, the listed steps or options need not be exhaustive.

The disclosure of the invention as found herein is to be considered to encompass all embodiments as found in the claims as being multiply dependent upon each other irrespective of the fact that claims may be found without multiple dependency or redundancy.

Preferably, the closure comprises a closure coupler to engage the closure with the outer container in assembled state. The closure coupler may be comprised of screw members, pressure fastening elements, lock fastening elements due to shape, or friction fastening elements or any combination thereof. Preferably, the closure coupler is comprised of screw members or friction fastening elements. Preferably, the closure comprises pump assembly, more preferably a hand pump which is actuated by pressing with the hand.

The outer container may be in any suitable shape, for example polyhedron, cylinder, truncated cone, sphere shaped or in the shape of animal. It is preferable that the outer container is in shape of polyhedron, cylinder, or truncated cone, more preferably in shape of cylinder or truncated cone. Most preferably the outer container is in shape of cylinder.

Preferably the engagement structure cooperates with the engagement coupler by a threaded connection. More preferably, the engagement structure of the outer container comprises at least one thread on the outside of the side wall for engaging the at least one thread at the body of the outer container. To secure the inner container firmly, the engagement structure of the outer container comprises at least two threads at the outside of the side wall for engaging the at least two threads of the engagement coupler on the body of the outer container.

Alternatively, the engagement mechanism of the engagement structure with the engagement coupler may be in any other different form. For example, the engagement mechanism may comprise pressure fastening elements, lock fastening elements due to shape, or friction fastening elements or any combination thereof. Preferably, the engagement structure cooperates with the engagement coupler by shape-locking. More preferably the engagement structure of the outer container comprises at least two horizontally spaced apertures on the inside wall of the outer container for snap-locking the at least two outwardly extending protrusion of the engagement coupler at the side wall of inner container to bring the inner container into the fully engaged position.

To fasten the inner container firmly and/or replace the inner container easily, the engagement structure of the outer container is in the lower portion of the body and the engagement coupler of the inner container is in the lower portion of the side wall. Lower portion as used herein means the portion below the middle of the container. The engagement structure in the lower portion means the whole engagement structure is in the lower portion.

The annular extension may be releasably engaged with the open top end in any way. However, to avoid any leakage of consumer products inside the inner container and/or to replace the inner container easily, it is preferred that the annular extension is engaged with the open top end by friction fastening and the open top end is sealed by the annular extension. More preferably, the outer diameter of the annular extension equals the inner diameter of the open top end, or the inner diameter of the annular extension equals the outer diameter of the open top end. Even more preferably, the outer diameter of the annular extension equals the inner diameter of the open top end.

In order to replace the inner container easily, the open top end is preferably large enough to operate. Typically, the diameter of the open top end is at least 10%, more preferably at least 50%, even more preferably 70% to 100% of the diameter of closed bottom end. The ratio of the diameter of the open top end to the diameter of the close bottom end may rely on the volume of the inner container. When the inner container has a volume of less than 100 ml, the ratio of the diameter of the open top end to the diameter of the close bottom end is preferably from 0.4, more preferably 0.5 to 1, even more preferably from 0.8 to 1. When the inner container has a volume of at least 100 ml, the ratio of the diameter of the open top end to the diameter of the close bottom end is preferably from 0.02 to 1, more preferably 0.05 to 0.8, even more preferably from 0.1 to 0.6.

Preferably, in order to facilitate the assembly of inner container into the outer container, the closed bottom end comprises a bottom and a ridge at the bottom of the closed bottom end. Thus, the inner container may be easily assembled by rotating the ridge. More preferably, the length of the ridge is at least 50% of the diameter of the bottom.

To facilitate the assembly of inner container into the outer container and/or to stably place the kit on a level surface, the closed bottom end preferably comprises a pedestal. The pedestal may be rotated easily when assembling the inner container. Preferably, the pedestal has the same shape as the outer container. More preferably, the pedestal is cylindrical. Even more preferably the outer diameter of the pedestal is not less than that of the outer container. Most preferably, the outer diameter of the pedestal is substantially the same as the outer diameter of the body.

The consumer product packaging kit may be made of any suitable material including plastic, glass, metal, paper, or combination thereof. However, it is preferable that the consumer product packaging kit is made of rigid plastic. More preferably the consumer product packaging kit is made of material polypropylene, polyethylene, polyethylene terephthalate, polyester, polyvinyl chloride, or mixtures thereof The inner container may be closed with a lid to form a refill container for the consumer to purchase. Thus, a refill container comprises an inner container of the present invention and a lid closing the inner container. Preferably the lid is made of flexible material, more preferably flexible plastics, even more preferably flexible polyethylene. When the refill container is to be replaced, the lid may be removed and the inner container may be replaced with a new one to replace the old inner container.

The consumer product packaging kit may be used to store any suitable viscous consumer product, for example personal care products including creams, moisturizers, conditioners, shampoos, facial cleansers, deodorants; home care products and food products. Preferably, the consumer product packaging kit is used to store skin care and/or hair care products, more preferably leave-on products. The term "leave-on" as used with reference to products herein means a product that is applied to or rubbed on the skin and/or hair, and left thereon.

EXAMPLES

The following example is provided in FIGS. 1 to 12 to facilitate an understanding of the invention. The example is not intended to limit the scope of the claims.

Figure 2:
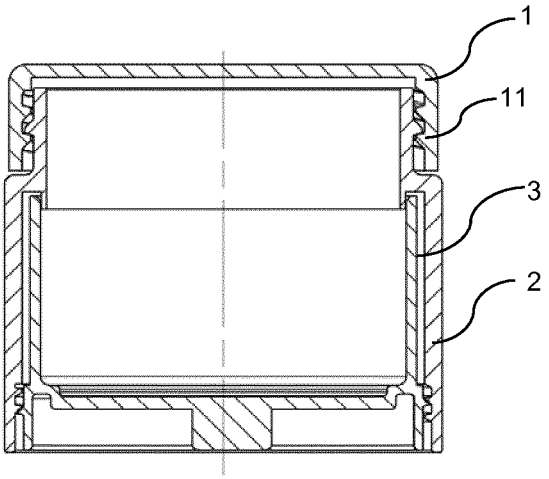
FIG. 2 is a cross-sectional view of the consumer product packaging kit corresponding to section A-A' shown in FIG. 1.
Figure 3:
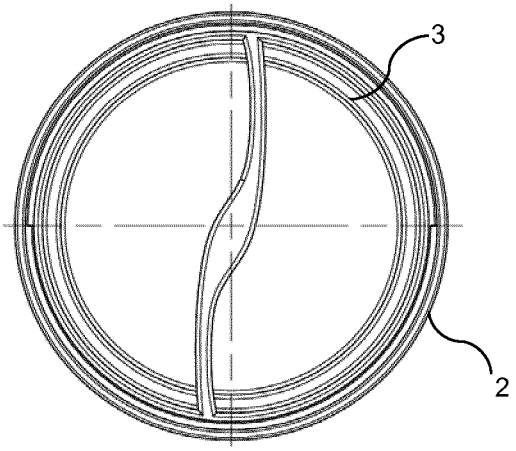
FIG. 3 is a bottom view of the preferred example of the consumer product packaging kit as shown in FIG. 1.
Figure 4:
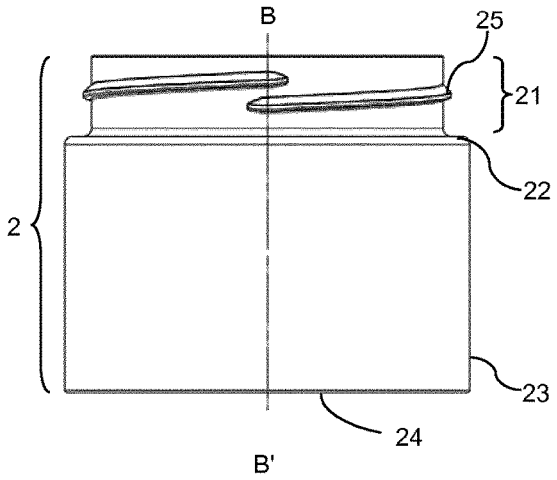
FIG. 4 is a front view of the outer container of the preferred example of the consumer product packaging kit as shown in FIG. 1.

FIGS. 1 to 3 illustrate a preferred example of the consumer product packaging kit according to the present invention, in an assembled state. The consumer product packaging kit comprises three separate parts, i.e. a closure 1, an outer container 2, and an inner container 3. FIG. 2 illustrates the longitudinal section of the consumer product packaging kit. In assembled state, the closure 1 is engaged with the outer container 2 through the closure coupler 11. The closure coupler 11 also allows the closure 1 to be detachable from the outer container 2. The outer container 2 is engaged with the inner container 3.

FIGS. 4 to 7 illustrate the preferred outer container of the present invention. As can be seen from FIG. 4, the outer container 2 comprises a mouth 21, a shoulder 22, a body 23, and an open base 24 opposite the mouth. The open base 24 is open thus the inner container 3 can be assembled through the open base 24 of the outer container 2. The outer container 2 is preferably in the shape of a cylinder. Alternatively, the outer container 2 is truncated cone shaped. On the outer surface of the mouth 21 of the outer container 2, there is container coupler 25 to secure the closure 1 when the closure 1 is fully engaged. Preferably, the container coupler 25 comprises screw members. More preferably, the container coupler 25 comprise at least one thread at the outer surface of the mouth 21 for engaging the at least one thread inside the closure 1.

Figure 5:
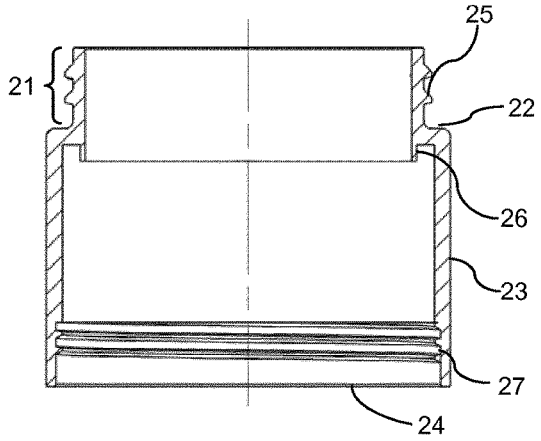
FIG. 5 is a cross-sectional view of outer container corresponding to section B-B' shown in FIG. 4.
Figure 6:
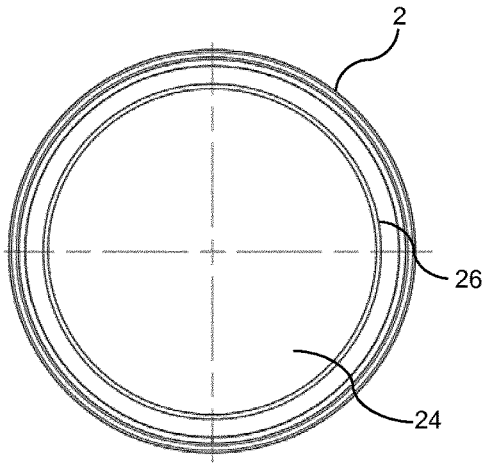
FIG. 6 is a bottom view of the outer container as shown in FIG. 4.
Figure 7:
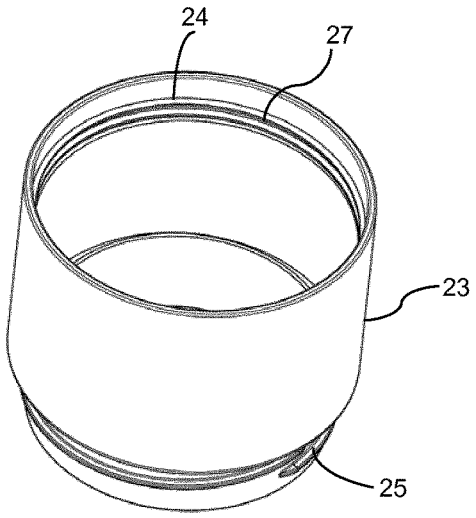
FIG. 7 is an inverted perspective view of the outer container as shown in FIG. 4.

As can be seen from FIG. 5 and FIG. 6, the outer container 2 comprises an annular extension 26 longitudinally extending from the month 21. The outer container 2 also comprises an engagement structure 27 comprising at least one thread at the body 23 as can be seen from FIG. 5 and FIG. 7. Preferably, the engagement structure 27 is at the lower portion of the body 23. Thus, the inner container 3 may be firmly fastened with the outer container 2.

Figure 8:
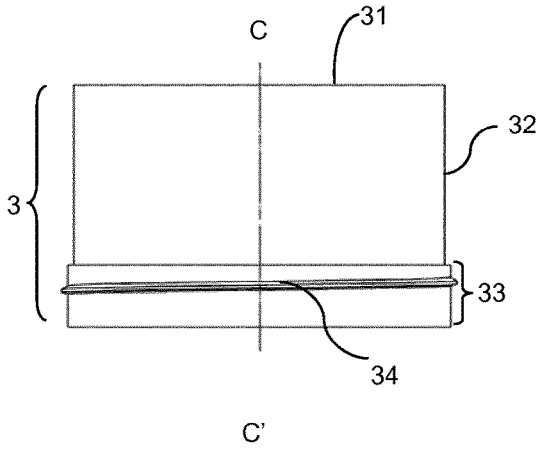
FIG. 8 is a front view of the inner container of the preferred example of the consumer product packaging kit as shown in FIG. 1.
Figure 9:
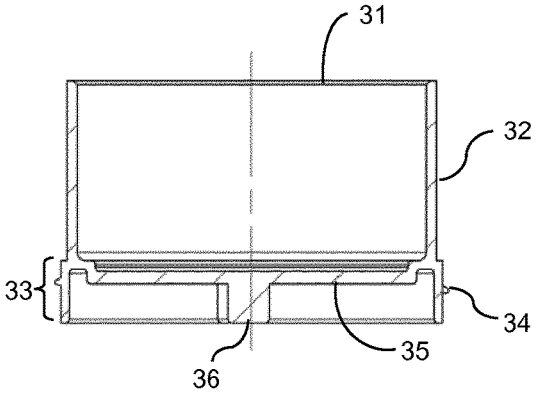
FIG. 9 is a cross-sectional view of inner container corresponding to section C-C' shown in FIG. 8.
Figure 10:
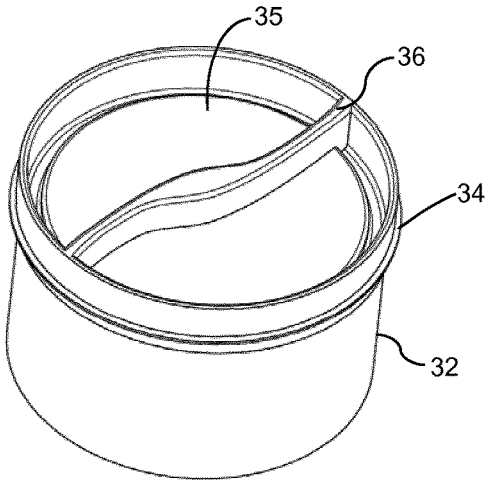
FIG. 10 is an inverted perspective view of the inner container as shown in FIG. 8.

FIGS. 8 to 10 illustrate the preferred inner container 3 of the present invention. The inner container 3 comprises an open top end 31 to engage the annular extension 26 of the outer container 2 to secure the inner container 3 to the outer container 2 when the inner container 3 is in a fully engaged position, a side wall 32, a closed bottom end 33 which comprises a threaded engagement coupler 34, so that the inner container 3 can be screwed to the body 23 of the outer container 2 when the inner container 3 is in a fully engaged position.

Alternatively, the engagement mechanism between the engagement structure 27 and the engagement coupler 34 may be comprised of pressure fastening elements, lock fastening elements due to shape, or any combination thereof. Preferably, the engagement structure 27 cooperates with the engagement coupler 34 by shape-locking. More preferably, the engagement structure 27 comprises at least two horizontally spaced apertures on the inside wall of the outer container 2 for snap-locking the at least two outwardly extending protrusion of the engagement coupler 34 at the side wall 32 of inner container 3 to bring the inner container into the fully engaged position.

To secure the inner container 3 to the outer container 2 via the open top end 31, it is preferable that the outer diameter of the annular extension 26 equals the inner diameter of the open top end 31, or the inner diameter of the annular extension 26 equals the outer container of the open top end 31. More preferably, the outer diameter of the annular extension 26 equals the inner diameter of the open top end 31.

The closed bottom end 33 comprises a bottom 35. To assemble the inner container 3 easily, in a preferred embodiment, the closed bottom end 33 comprises a ridge 36 located on the bottom 35 of the inner container 3, so that the consumer can rotate and/or hold the inner container 3 easily via the ridge 36 to assemble the inner container 3 inside the outer container 2.

The inner container 3 may be closed with a lid to form a refill container. Such refill containers may be commercialized separately for consumers. In a preferred embodiment, the lid is made of polyethylene. When the consumer product inside the original inner container is used up, the consumer may take the lid off from the refill container and replace the original inner container with a new refill container. Once the refill container (i.e. the new inner container) is assembled into the outer container 2, the annular extension 26 is secured to the open top end 31 of the new inner container 3 to avoid product leakage. The engagement mechanism on the closed bottom end 33 of the new inner container 3 is also secured to the engagement mechanism on the body 23 of outer container 2.

Figure 11:
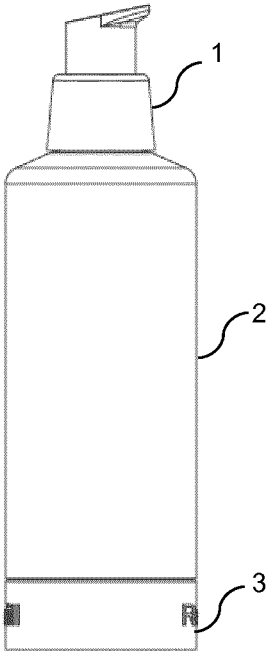
FIG. 11 is a front view of a second preferred example of the consumer product packaging kit according to this present invention.
Figure 12:
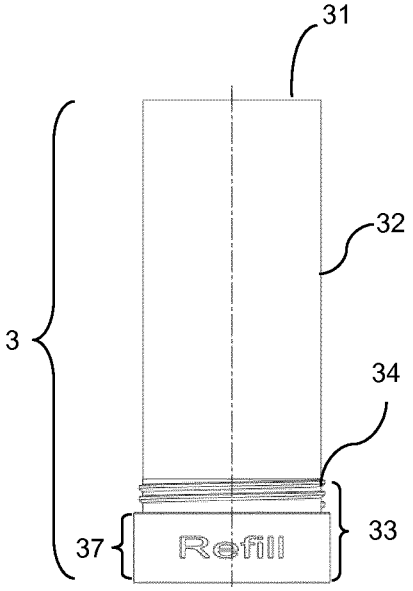
FIG. 12 is a front view of the inner container of the second preferred example of the consumer product packaging kit as shown in FIG. 11.

FIGS. 11 to 12 illustrate a second preferred example of the consumer product packaging kit according to the present invention. The consumer product packaging kit comprises three separate parts, i.e. a closure 1, an outer container 2, and an inner container 3. The closure 1 comprises a hand pump. FIG. 12 shows a front view of the inner container 3 of the second preferred example. The inner container 3 comprises an open top end 31 to engage with the annular extension 26 (not shown in the figure) to secure the inner container 3 to the outer container 2 when the inner container 3 is in a fully engaged position, a side wall 32, a closed bottom end 33 and a threaded engagement coupler 34, so that the inner container 3 can be screwed to the body 23 of outer container 2 when the inner container 3 is in a fully engaged position. The closed bottom end 33 comprises a pedestal 37. Both of the pedestal 37 and body 23 are cylindrical. The outer diameter of the pedestal 37 is substantially the same as the outer diameter of the body 23. The consumer may rotate and/or hold the inner container 3 easily via the pedestal 37 to assemble the inner container 3 inside the outer container 2. The inner container 3 may also be closed by a lid to form a refill container containing consumer products for the consumer to purchase.

The invention claimed is:

1. A consumer product packaging kit comprising a closure (1), an outer container (2) and an inner container (3) capable of releasably engaging with and inside of the outer container (2), wherein:

A) the outer container (2) comprises:

a) an open mouth (21) at the top of the outer container (2), b) a shoulder (22) extending outwardly from a lower portion of the open mouth, c) a body (23), d) an open base (24) at the bottom of the outer container (2), e) said open mouth including, at a level above the shoulder, a container coupler for securing a closure f) an annular extension (26) longitudinally, vertically offset from the open mouth (21) and at a level below the shoulder (22), and g) an engagement structure (27); and B) the inner container (3) for containing consumer product comprises:

(i) an open top end (31) releasably engaging with the annular extension (26) to secure the inner container (3) to the outer container (2) when the inner container (3) is in a fully engaged position, (ii) a side wall (32), (iii) a closed bottom end (33), and (iv) an engagement coupler (34) cooperating with the engagement structure (27) to secure the inner container (3) to the body (23) of the outer container (2) when the inner container (3) is in a fully engaged position, wherein the engagement structure (27) is in a lower portion of the body (23) and the engagement coupler (34) is in a lower portion of the side wall (32), wherein the engagement structure (27) cooperates with the engagement coupler (34) by shape-locking or by a threaded connection to bring the inner container into the fully engaged position and wherein an outer diameter of the annular extension (26) is equal to an inner diameter of the open top end (31).

2. The consumer product packaging kit according to claim 1 wherein the engagement structure (27) cooperates with the engagement coupler (34) by a threaded connection.

3. The consumer product packaging kit according to claim 1 wherein the closed bottom end (33) comprises a bottom (35) and a ridge (36) at the bottom (35).

4. The consumer product packaging kit according to claim 1 wherein the closed bottom end (33) comprises a pedestal (37), the outer diameter of the pedestal (37) is same as the outer diameter of the body (23).

5. The consumer product packaging kit according to claim 1 wherein the inner container (3) is made of rigid plastics.

* * * * *